US007585155B2

(12) United States Patent
Park et al.

(10) Patent No.: US 7,585,155 B2
(45) Date of Patent: Sep. 8, 2009

(54) AXIAL FLOW FAN

(75) Inventors: Se-Young Park, Daejeon-si (KR); Kyung-seok Cho, Daejeon-si (KR)

(73) Assignee: Halla Climate Control Corp., Daejeon-si (KR)

( * ) Notice: Subject to any disclaimer, the term of this patent is extended or adjusted under 35 U.S.C. 154(b) by 400 days.

(21) Appl. No.: 11/081,082

(22) Filed: Mar. 16, 2005

(65) Prior Publication Data

US 2005/0207894 A1 Sep. 22, 2005

(30) Foreign Application Priority Data

Mar. 19, 2004 (KR) ..... 10-2004-0018645

(51) Int. Cl.
*F04D 29/38* (2006.01)

(52) U.S. Cl. ..... 416/189; 416/237; 416/238; 416/242; 416/DIG. 2; 416/DIG. 5

(58) Field of Classification Search ..... 416/169 A, 416/189, 192, 223 R, 228, 237, 238, 242, 416/243, DIG. 2, DIG. 5; 415/119
See application file for complete search history.

(56) References Cited

U.S. PATENT DOCUMENTS

| | | | | |
|---|---|---|---|---|
| 6,287,078 | B1 | 9/2001 | Min et al. | |
| 7,044,712 | B2 * | 5/2006 | Cho et al. | 416/169 A |
| 7,121,807 | B2 * | 10/2006 | Cho et al. | 416/242 |
| 2003/0012656 | A1 | 1/2003 | Cho et al. | |

* cited by examiner

*Primary Examiner*—Christopher Verdier
(74) *Attorney, Agent, or Firm*—Lowe Hauptman Ham & Berner LLP

(57) ABSTRACT

Blades mounted on a circumferential outer surface of a hub of an axial flow fan do not deform even when rotated at high speed, thus promoting structural stability. The direction of the sweeping angle of each blade alternately changes between the blade root and tip. A chord length between the blade leading and trailing edges gradually decreases from the blade root to an intermediate portion of the blade, and the chord length gradually increases from a predetermined position on the intermediate portion of the blade to the blade tip.

6 Claims, 13 Drawing Sheets

AXIAL FLOW FAN

RELATED APPLICATION

The present application is based on, and claims priority from, KR Application Number 2004-018645, filed Mar. 19, 2004, the disclosure of which is hereby incorporated by reference herein in its entirety.

BACKGROUND OF THE INVENTION

1. Field of the Invention

The present invention relates generally to axial flow fans and, more particularly, to an axial flow fan which prevents deformation of blades even when rotated at high speed, thus promoting structural stability, and which achieves high efficiency and satisfactory capacity despite a low rotational frequency.

2. Background of the Related Art

As well known to those skilled in the art, axial flow fans are used to cool a heat exchanging medium circulating in, for example, a heat exchanger of a vehicle, such as a radiator or a condenser. As shown in FIG. 1, such an axial flow fan 10 includes a hub 20 which is coupled to an output shaft 52 of a drive unit 50 such as a motor, a plurality of blades 30 which are radially arranged along a circumferential outer surface of the hub 20, and a fan band 40 which couples outer ends of the blades 30 together to prevent deformation of the blades 30. The axial flow fan 10 having the above-mentioned construction is rotated by a rotational force transmitted from the drive unit 50 to the hub 20, so that air is blown in an axial direction by the rotation of the blades 30 of the axial flow fan 10.

Typically, the axial flow fan 10 is made of synthetic resin and formed as a single body. To efficiently guide air blown by the axial flow fan 10 to a heat exchanger, the axial flow fan 10 is assembled with a shroud 60 which is mounted to the heat exchanger. The shroud 60 to guide blown air includes a blast port having a predetermined size such that the axial flow fan 10 may be rotatably inserted into the shroud 60. The shroud 60 has a structure capable of supporting therein the motor 50 which is the drive unit.

As shown in FIG. 2, in each blade 30 of the conventional axial flow fan 10, both a leading edge (LE), which is an edge of the blade 30 in a rotational direction, and a trailing edge (TE), which is an edge of the blade 30 in a direction opposite the rotational direction, are curved in the direction opposite the rotational direction while extending from a blade root 32, which is a junction between the hub 20 and the blade 30, to an intermediate portion of the blade 30, thus forming a backward sweeping angle. Both the leading edge (LE) and the trailing edge (TE) of the blade 30 are integrated and curved in the rotational direction while extending from the intermediate portion of the blade 30 to the blade tip 34, which is the junction between the blade 30 and the fan band 40.

Such change of the sweeping angle of the blade 30 serves as an important factor to enhance the performance of the axial flow fan 10. However, it has been well-known that it is very difficult to achieve satisfactory air blowing efficiency and noise reduction.

In consideration of this, several axial flow fans were proposed in Korean Patent Laid-open Publication No. 2002-94183 and No. 2002-94184, which were filed by the inventor of the present invention.

As shown in FIGS. 3 and 4, an axial flow fan 10*a* of No. 2002-94183 includes a plurality of blades 30*a* each having a wave shape in which the sweeping angles of both a leading edge (LE) and a trailing edge (TE) alternate between forwards and backwards from a blade root 32*a* to a blade tip 34*a*. Furthermore, a chord length (CL), which is the length from the leading edge (LE) to the trailing edge (TE) of the blade 30*a* at the same radius, gradually increases from a blade root 32*a* to a blade tip 34*a*. In the drawings, the reference character "α" denotes the angle at which each blade 30*a* is disposed with respect to the horizon (H) when the axial flow fan 10*a* is level with the horizon (H). In the drawings, the reference numeral 20*a* denotes a hub, and 40*a* denotes a fan band.

As shown in FIGS. 5 and 6, an axial flow fan 10*b* of No. 2002-94184 includes a plurality of blades 30*b* each having a wave shape the same as that described for the axial flow fan 10*a* of No. 2002-94183. As well, the chord length (CL) of each blade 30*b* gradually increases from a blade root 32*b* to a blade tip 34*b*. Each blade 30*b* has a maximum backward sweeping angle at the blade root 32*b* and has a maximum forward sweeping angle at the blade tip 34*b*. In the drawings, the reference numeral 20*b* denotes a hub, and 40*b* denotes a fan band.

In the conventional axial flow fans 10*a* and 10*b* having a wave shape, air passing through the axial flow fan 10*a*, 10*b* is dispersed in a region between inflection points in which the direction of the sweeping angle changes. Therefore, concentration of the flowing air is prevented, thus improving air blowing efficiency and reducing noise.

However, in the conventional axial flow fans 10*a* and 10*b*, because the chord length (CL) gradually increases from the blade root 32*a*, 32*b* to the blade tip 34*a*, 34*b*, the blade tip 34*a*, 34*b* is structurally unstable. Accordingly, when the axial flow fan 10*a*, 10*b* is rotated at high speed, deformation of the blades 30*a*, 30*b* may occur. Particularly, the deformation of the blade tips 34*a*, 34*b* hampers the noise reducing function of the axial flow fan 10*a*, 10*b*.

Furthermore, in the case of the axial flow fan 10*b* of No. 2002-94184, the angle (α1) between a line (L0), passing through both the center (O) of the hub 20*b* and an intersection point between the blade root 32*b* and a mid-chord line (ML), which connects middle points between the leading edge (LE) and the trailing edge (TE) of the blade 30*b*, and a line (L1), passing through both the center (O) of the hub 20*b* and an intersection point between the mid-chord line (ML) and the blade tip 34*b*, is smaller than an angle (α2) between the line (L0) and a line (L2), passing through both the center (O) of the hub 20*b* and a first inflection point (P1), defined at a first valley on the mid-chord line (ML), and is smaller than an angle (α3) between the line (L0) and a line (L3), passing through both the center (O) of the hub 20*b* and a second inflection point (P2) defined at a second valley on the mid-chord line (ML) ($\alpha 1<\alpha 2, \alpha 3$). In other words, the difference in width between each valley and opposite ends of the mid-chord line (ML) is large, and the forward sweeping angle of the blade tip 34*b* is excessively large. Thus, the conventional axial flow fan 10*b* must be increased in rotational frequency to achieve satisfactory capacity. As a result, there is difficulty in reducing noise occurring during the rotation of the axial flow fan 10*b*.

SUMMARY OF THE INVENTION

Accordingly, the present invention has been made keeping in mind the above problems occurring in the prior art, and an object of the present invention is to provide an axial flow fan which prevents the deformation of blades even when rotated at high speed, thus promoting structural stability, and which achieves high efficiency and satisfactory capacity despite a low rotational frequency.

In order to accomplish the above object, the present invention provides an axial flow fan, including: a hub; and a plurality of blades arranged along a circumferential outer surface of the hub in a radial direction such that a direction of a sweeping angle of each of the plurality of blades alternately changes in a region between a blade root and a blade tip. A chord length, which is a length from a leading edge to a trailing edge of the blade, gradually reduces from the blade root to an intermediate portion of the blade and has a minimum value at a predetermined position on the intermediate portion of the blade, while the chord length gradually increases from the predetermined position of the intermediate portion of the blade having the minimum value to the blade tip. A second inflection point, defined at a second valley spaced apart from the blade root by a predetermined distance on a mid-chord line connecting middle points between the leading edge and the trailing edge, is placed ahead of a first inflection point, defined at a first valley formed between the blade root and the second valley on the mid-chord line, based on a first line passing through both a center of the hub and an intersection point between the mid-chord line and the blade root, in a direction of rotation.

In the present invention, when an outer radius of the hub is designated by "Rh", and a distance between the center of the hub and the blade root is designated by "Rt", and a distance between the center of the hub and an arbitrary position on the mid-chord line is designated by "r", the chord length may have the minimum value at a predetermined position satisfying an equation $(r-Rh)/(Rt-Rh)=0.2\sim0.6$.

Furthermore, an angle between the first line, passing through both the center of the hub and the intersection point between the mid-chord line and the blade root, and a second line, passing through both the center of the hub and an intersection point between the mid-chord line and the blade tip, may be greater than an angle between the first line and a third line, passing through both the center of the hub and the first inflection point and is greater than an angle between the first line and a fourth line, passing through both the center of the hub and the second inflection point.

The angle between the first line, passing through both the center of the hub and the intersection point between the mid-chord line and the blade root, and the third line, passing through both the center of the hub and the first inflection point, may be less than ½ of the angle between the first line and the second line, passing through both the center of the hub and the intersection point between the mid-chord line and the blade tip.

The axial flow fan may further include a fan band to integrally couple the blade tips of the plurality of blades together.

DESCRIPTION OF THE ELEMENTS IN THE DRAWINGS

120: hub
130: blade
132: blade root
134: blade tip
140: fan band
CL: chord length
LE: leading edge
ML: mid-chord line
O: center of hub
P1, P2: inflection points
r: distance from center of hub to arbitrary position on mid-chord line
Rh: outer radius of hub
Rt: distance from center of hub to blade tip
TE: trailing edge

DETAILED DESCRIPTION OF ONE PREFERRED EMBODIMENT

The features and advantages of the present invention will be more clearly understood from the following detailed description. Terms and words used in the specification and claims must be regarded as concepts selected by the inventor as the best method of illustrating the present invention, and must be interpreted as having meanings and concepts adapted to the scope and sprit of the present invention to understand the technology of the present invention.

Figure 1:
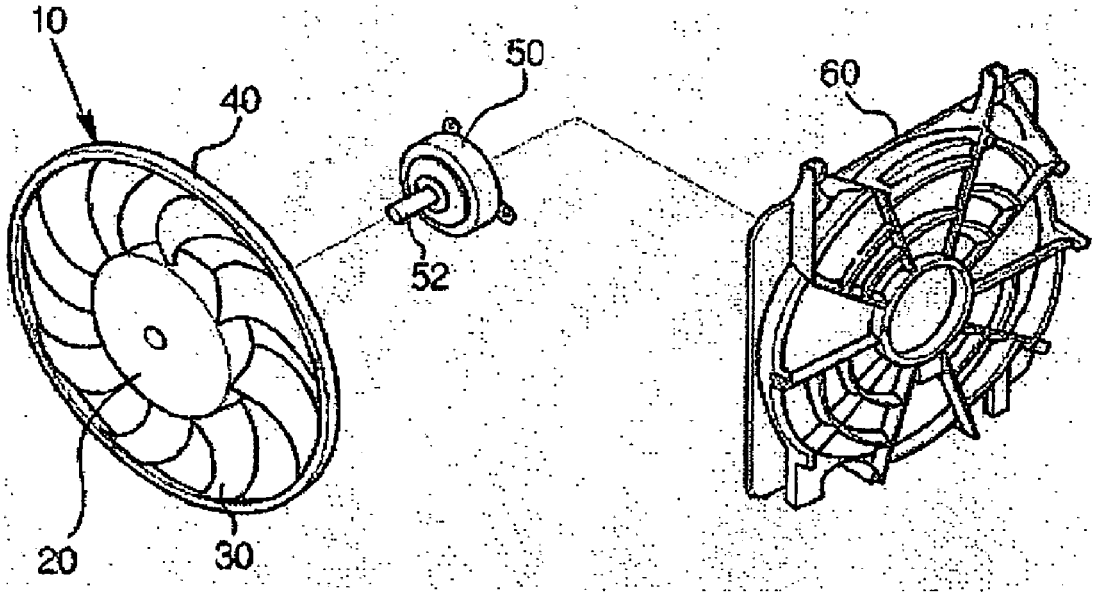
Fig. 1 (Prior Art)
FIG. 1 is an exploded perspective view showing an assembly of a conventional axial flow fan and a shroud.
Figure 2:
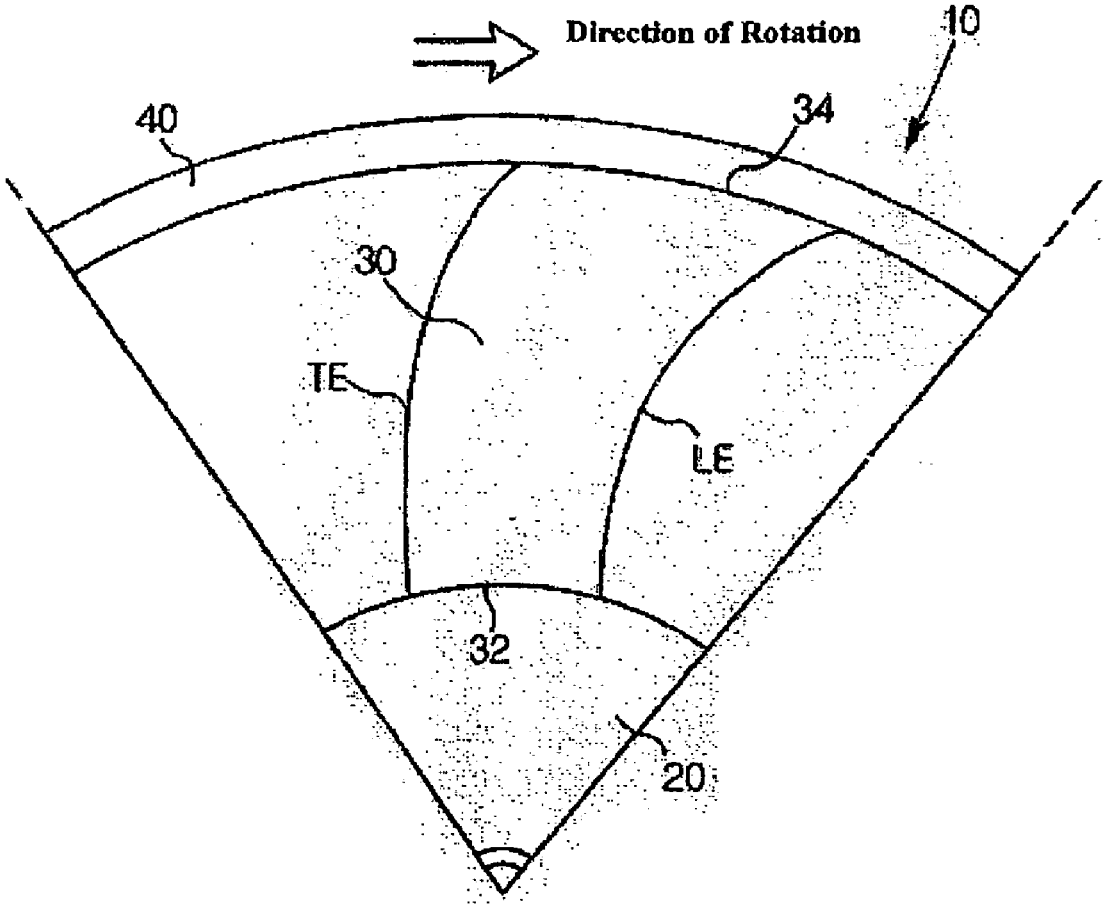
Fig. 2 (Prior Art)
FIG. 2 is a front view showing a part of the conventional axial flow fan of FIG. 1.
Figure 3:
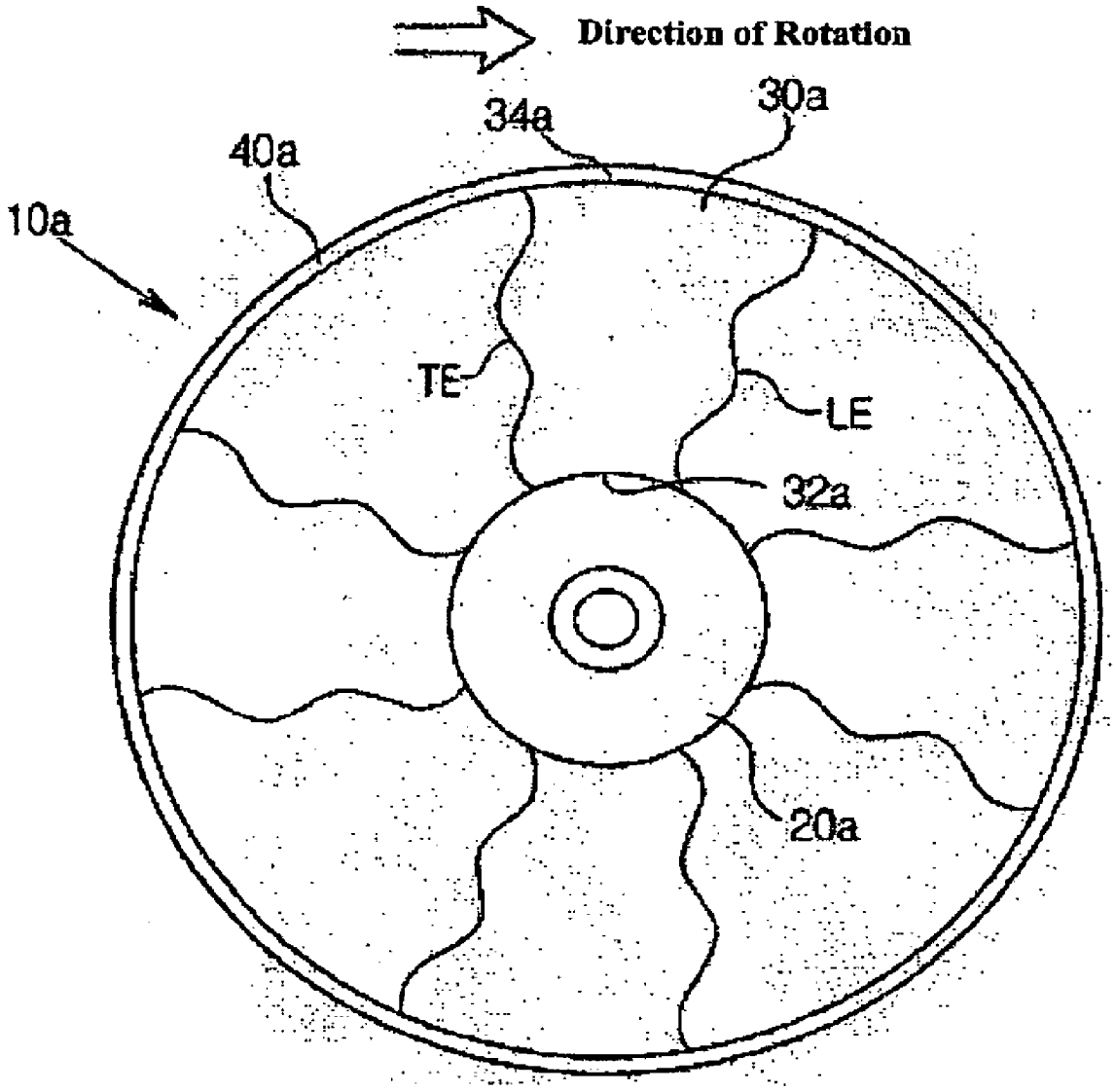
Fig. 3 (Prior Art)
FIG. 3 is a front view showing another conventional axial flow fan.
Figure 4:
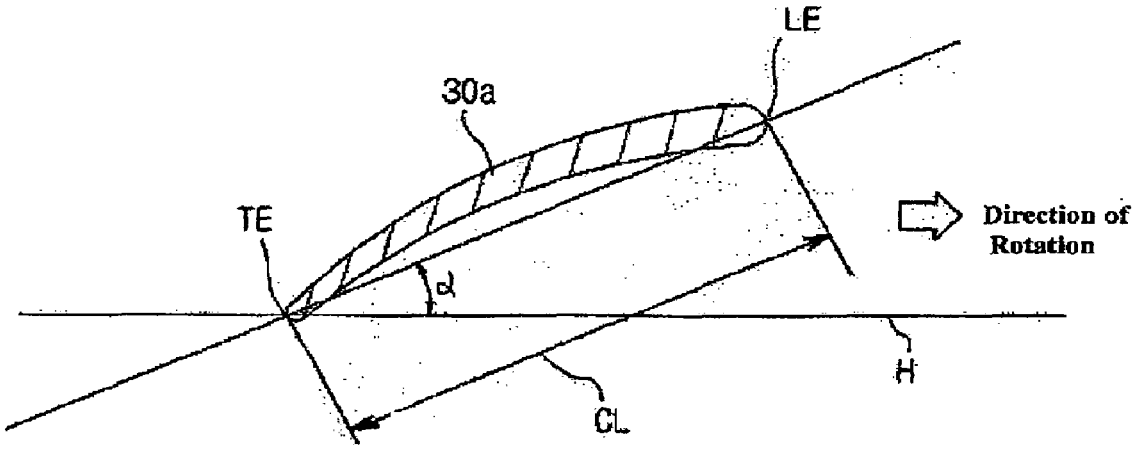
Fig. 4 (Prior Art)
FIG. 4 is a sectional view of a blade of the axial flow fan of FIG. 3 to illustrate the definition of chord length of the blade.
Figure 5:
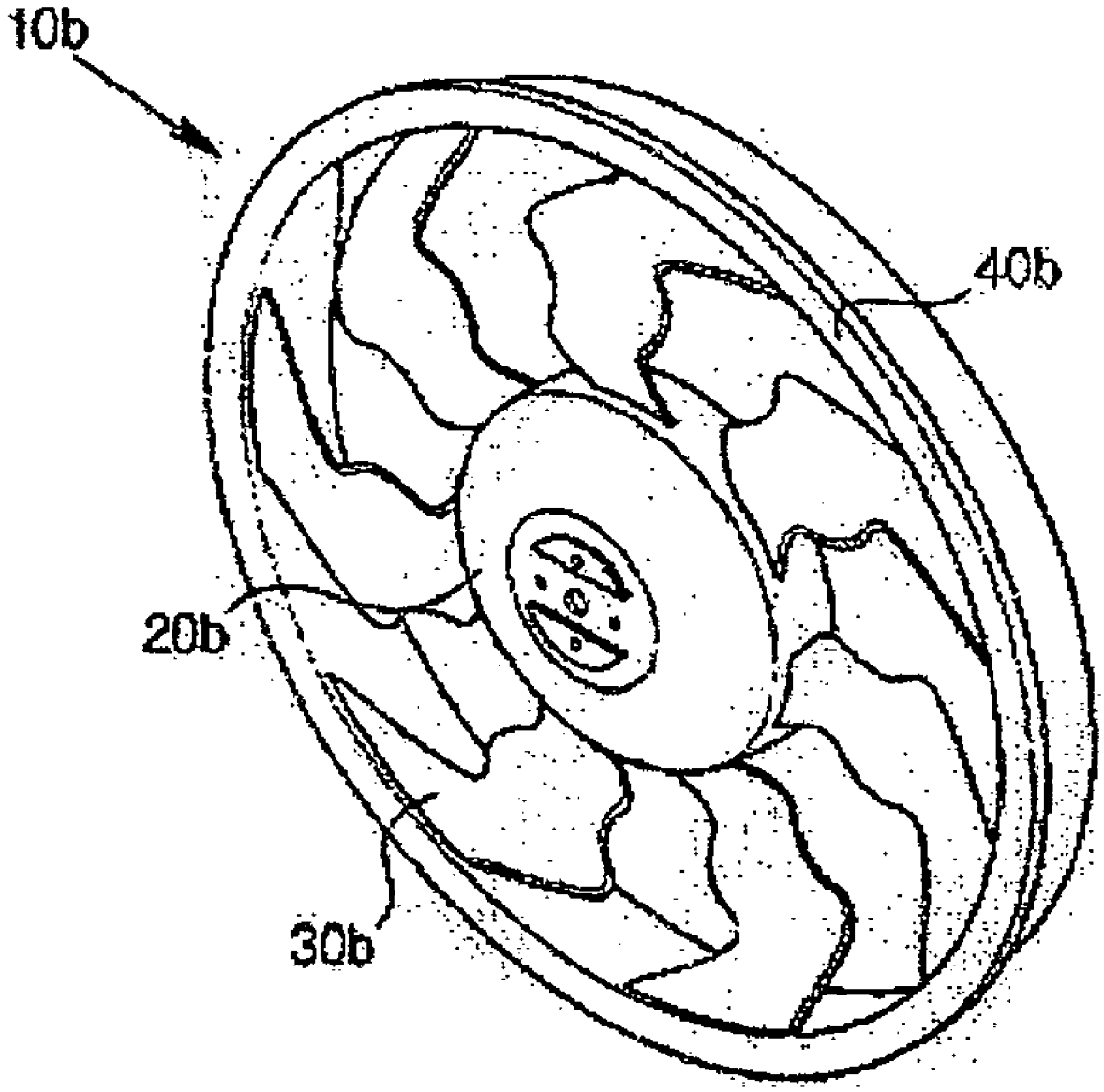
Fig. 5 (Prior Art)
FIG. 5 is a perspective view showing a further conventional axial flow fan.
Figure 6:
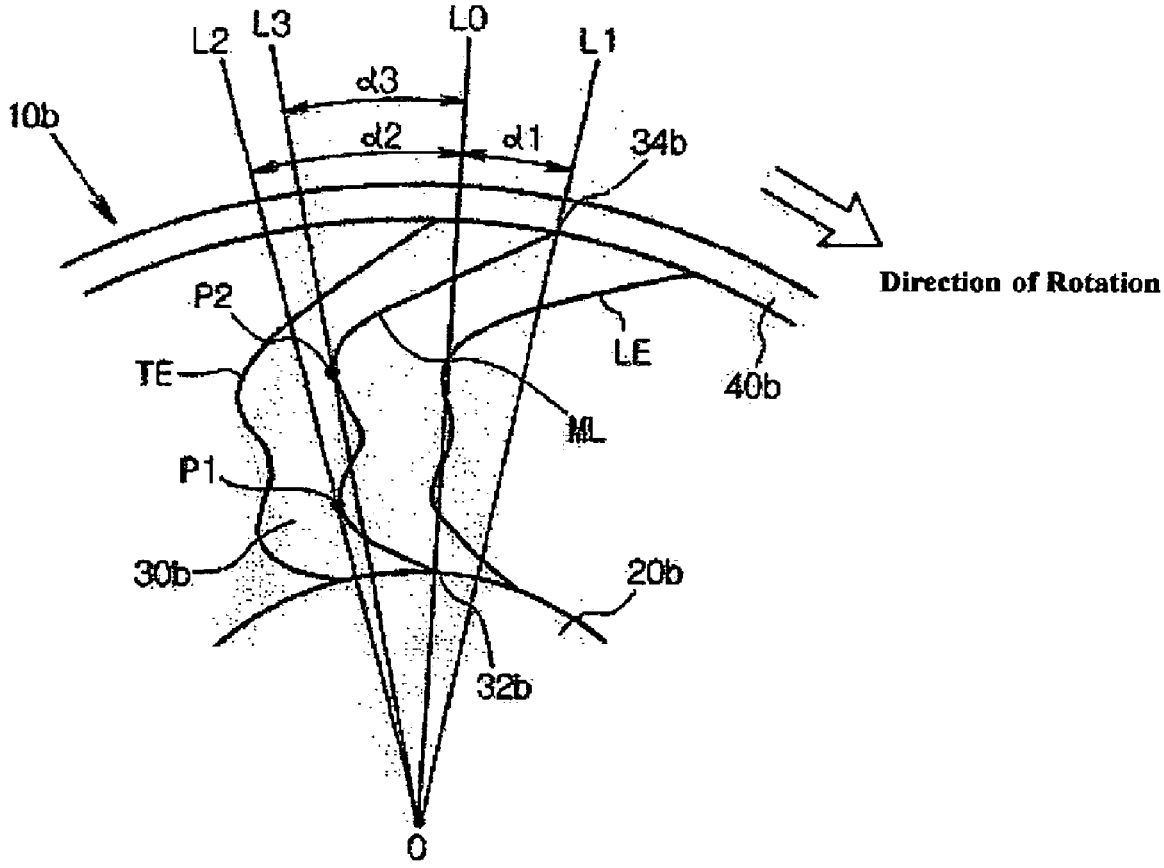
Fig. 6 (Prior Art)
FIG. 6 is a front view showing part of the conventional axial flow fan of FIG. 5.
Figure 8:
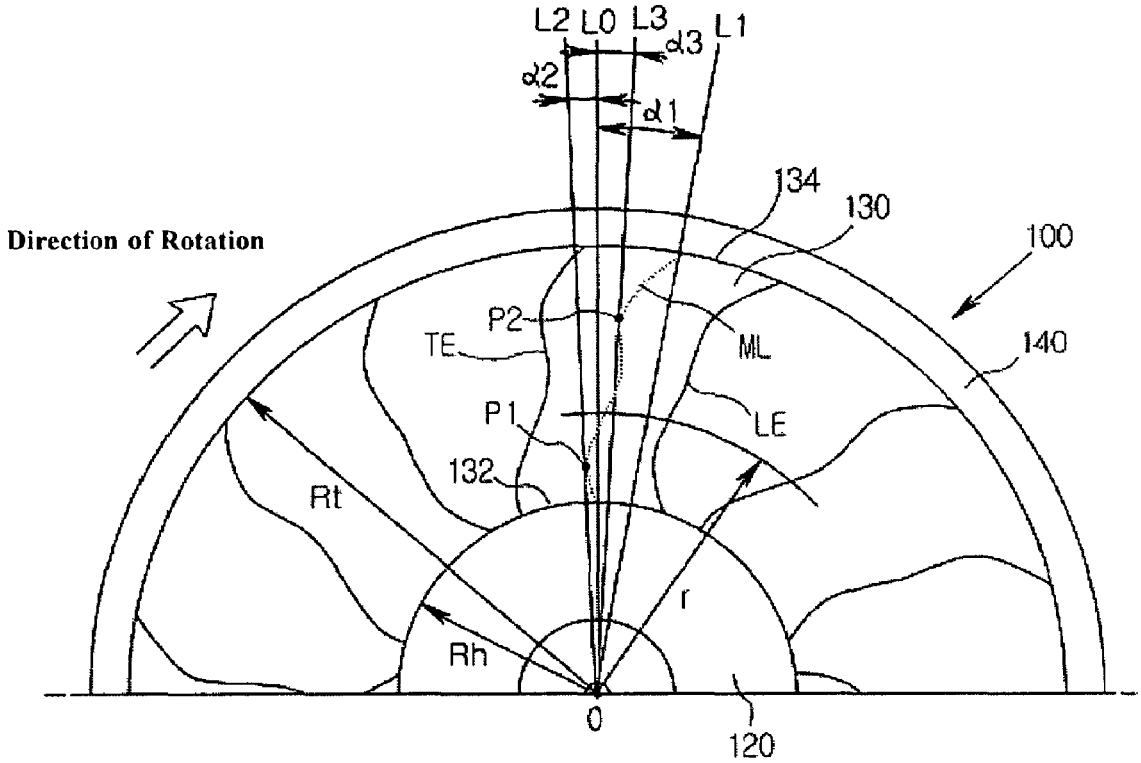
FIG. 8 is a front view showing an enlargement of a part of the axial flow fan of FIG. 7.

With reference to FIG. 8, in the present invention, a leading edge (LE) of a blade 130 denotes an edge of the blade 130 in a rotational direction. A trailing edge (TE) of the blade 130 denotes an edge of the blade 130 in a direction opposite the rotational direction. A chord length (CL) of the blade 130 denotes a length from the leading edge (LE) to the trailing edge (TE) of the blade 130 at the same radius (see, FIG. 4). A mid-chord line (ML) denotes a line connecting middle points between the leading edge (LE) and the trailing edge (TE) of the blade 130. A blade root 132 denotes a junction of the blade 130 and a hub 120. A blade tip 134 denotes an outside end of the blade 130. A forward sweeping angle denotes a sloping angle of the blade toward a rotational direction. A backward sweeping angle denotes a sloping angle of the blade toward a direction opposite to a rotational direction. First and second inflection points (P1 and P2) denote points at which the sweeping angle of the blade 130 changes from a backward sweeping angle to a forward sweeping angle.

Figure 7:
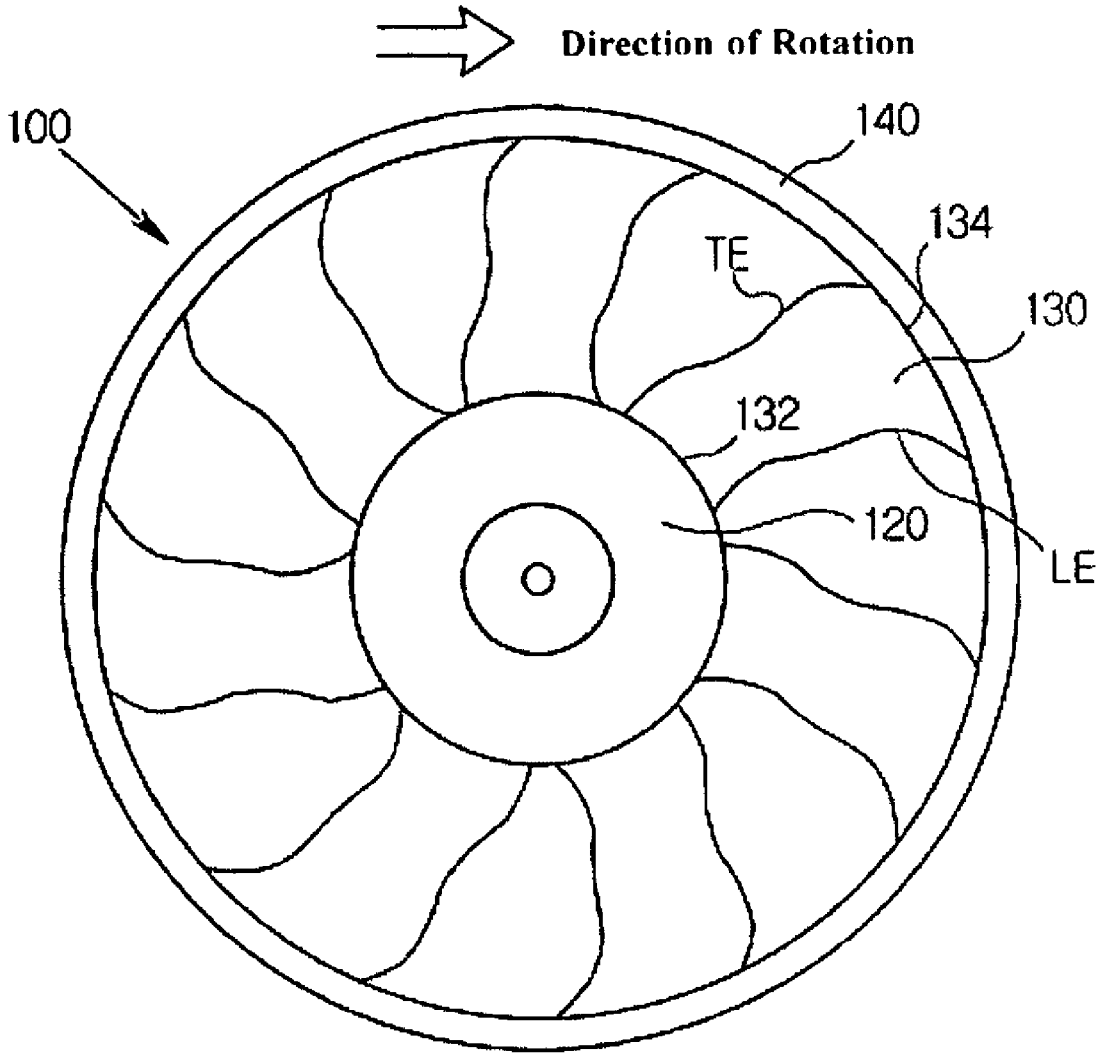
FIG. 7 is a front view of an axial flow fan, according to an embodiment of the present invention.

As shown in FIG. 7, an axial flow fan 100 of the present invention includes the hub 120 and a plurality of blades 130 which are arranged along a circumferential outer surface of the hub 120 in a radial direction such that the direction of the sweeping angle of each of the blades 130 alternately changes in a region between the blade root 132 and the blade tip 134. In other words, each blade 130 has a wave shape in which the sweeping angle alternately changes between a backward sweeping angle and a forward sweeping angle in the region defined between the blade root 132 and the blade tip 134.

As shown in FIG. 8, in the present invention, each blade 130 has a wave shape in which a direction of a sweeping angle of each of the leading edge (LE) and trailing edge (TE) of the blade 130 alternately changes at three inflection points.

The chord length (CL) of each blade 130 is gradually reduced from the blade root 132 to an intermediate portion of the blade 130. If an outer radius of the hub 120 is designated by "Rh", and the distance between the center of the hub 120 and the blade tip 134 is designated by "Rt", and the distance between the center of the hub 120 and an arbitrary position on the mid-chord line (ML), connecting the middle points between the leading edge (LE) and trailing edge (TE), is designated by "r", the chord length (CL) has the minimum value at a predetermined position satisfying an equation $(r-Rh)/(Rt-Rh)=0.2\sim0.6$. Furthermore, the chord length (CL) of the blade 130 gradually increases from the predetermined position of the intermediate portion of the blade 130 having the minimum value to the blade tip 134.

Figure 9:
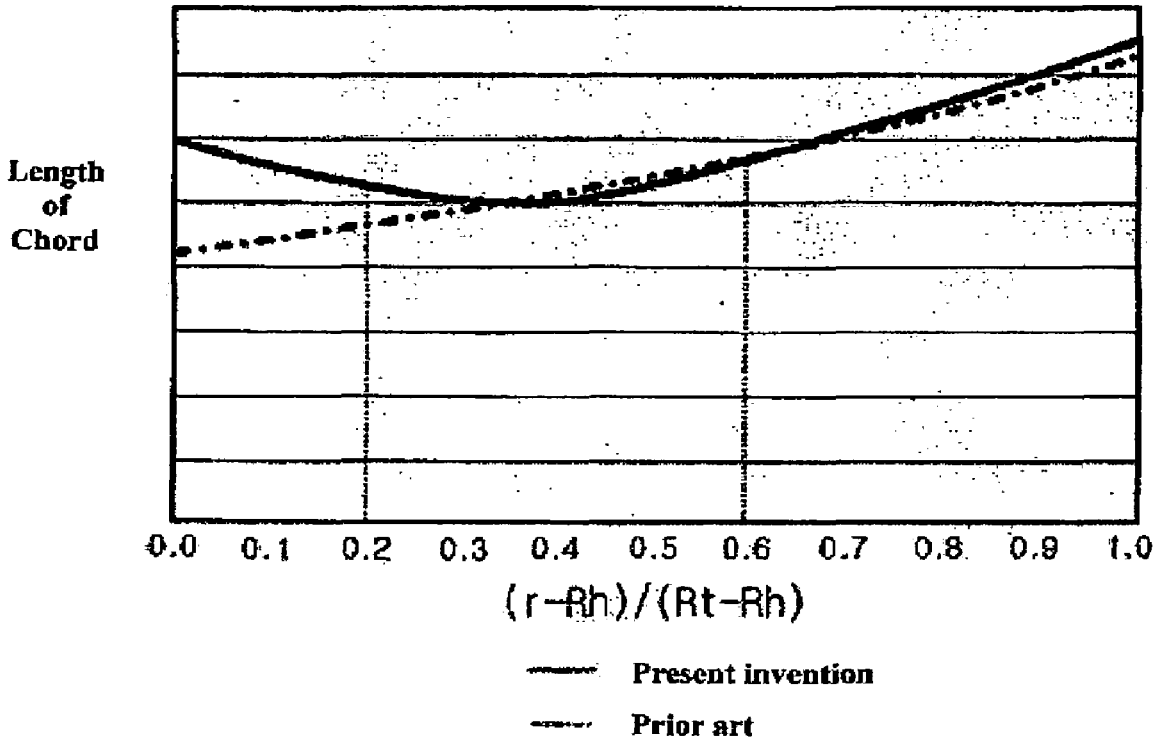
FIG. 9 shows a graph comparing changes of chord lengths of the axial flow fan of the present invention and a conventional axial flow fan.

FIG. 9 shows a graph comparing changes of chord lengths (CL) of the axial flow fan 100 of the present invention and a conventional axial flow fan having wave-shaped blades. As shown in FIG. 9, the chord length (CL) around the blade root 132 of the blade 130 of the axial flow fan 100 of the present invention is markedly longer than the chord length (CL) around a blade root of the blade of the conventional axial flow fan. Thus, it is to be readily understood that the axial flow fan 100 of the present invention has a stabler structure than the conventional axial flow fan.

Preferably, the angle ($\alpha$1) between a line (L0), passing through both the center (O) of the hub 120 and an intersection point between the mid-chord line (ML) and the blade root 132, and a line (L1), passing through both the center (O) of the hub 120 and an intersection point between the mid-chord line (ML) and the blade tip 134, is greater than an angle ($\alpha$2) between the line (L0) and a line (L2), passing through both the center (O) of the hub 120 and the first inflection point (P1) in the mid-chord line, and is greater than an angle ($\alpha$3) between the line (L0) and a line (L3), passing through both the center (O) of the hub 120 and the second inflection point (P2) in the mid-chord line.

Furthermore, preferably, the angle ($\alpha$2) between the line (L0) passing through both the center (O) of the hub 120 and the intersection point between the mid-chord line (ML) and the blade root 132, and the line (L2) passing through both the center (O) of the hub 120 and the first inflection point (P1), is smaller than ½ of the angle ($\alpha$1) between the line (L0) and the line (L1), passing through both the center (O) of the hub 120 and the intersection point between the mid-chord line (ML) and the blade tip 134.

The line (L3), passing through both the center (O) of the hub 120 and the second inflection point (P2), is defined ahead of the line (L2), based on the line (L0), in the rotational direction. That is, the second inflection point (P2), defined at a second valley spaced apart from the blade root 132 by a predetermined distance on the mid-chord line (ML), is placed ahead of the first inflection point (P1), defined at a first valley formed between the blade root 132 and the second valley on the mid-chord line (ML), based on the line (L0) passing through both the center (O) of the hub 120 and the intersection point between the mid-chord line (ML) and the blade root 132, in the rotational direction.

Figure 10:
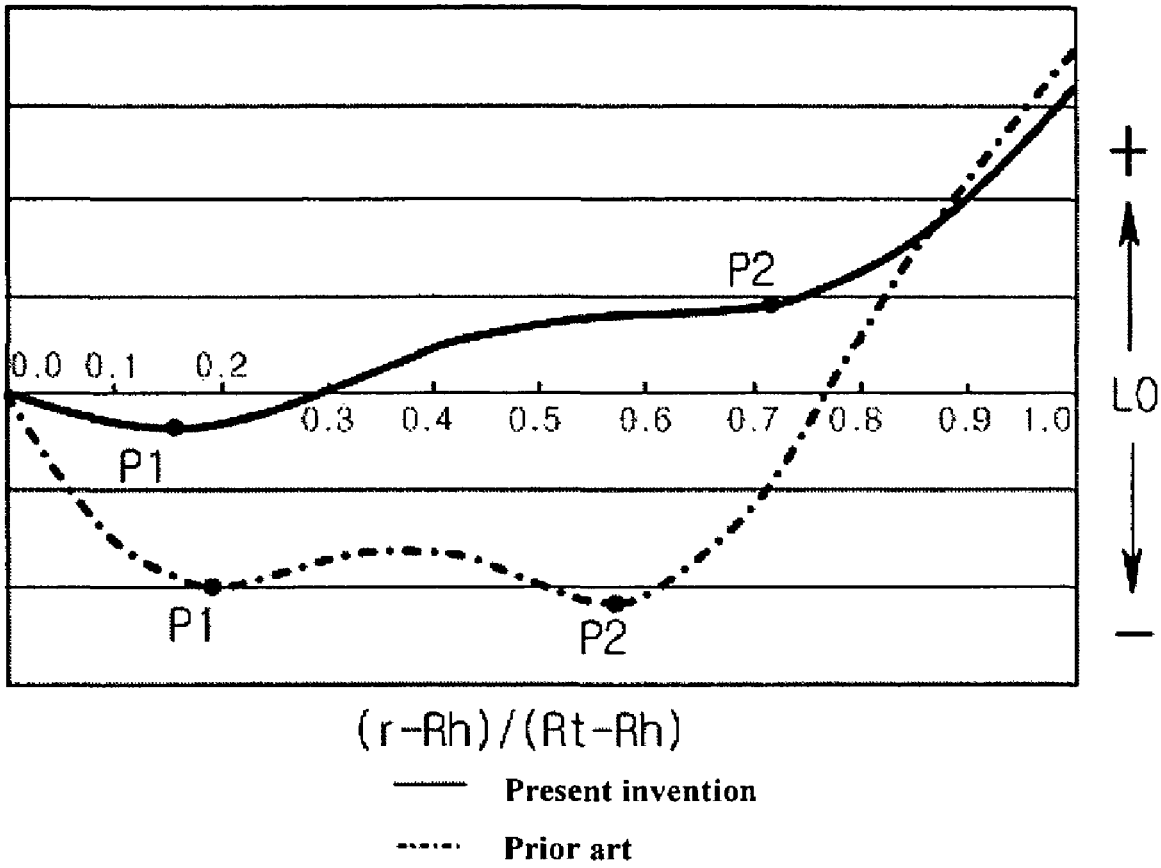
FIG. 10 shows a graph comparing the types of mid-chord lines of the axial flow fan of the present invention and the conventional axial flow fan.

FIG. 10 shows a graph comparing positions of first and second inflection points (that is, the types of mid-chord lines) of the axial flow fan 100 of the present invention and the conventional axial flow fan having the wave-shaped blades. As shown in FIG. 10, a forward side in a rotational direction with respect to the line (L0), passing through both the center (O) of the hub 120 and the intersection point between the mid-chord line (ML) and the blade root 132, is designated by "+". A backward side with respect to the line (L0) is designated by "−". Here, it is to be understood that, in the blade 130 of the axial flow fan 100 of the present invention, the second inflection point (P2) is placed ahead of the first inflection point (P1) in a rotational direction, while, in a blade of the conventional axial flow fan, the second inflection point (P2) is placed behind of the first inflection point (P1) in a rotational direction. Furthermore, it is to be understood that the range of the sweeping angle of the blade 130 of the axial flow fan 100 of the present invention which has an alternately changing direction is lower than that of the blade of the conventional axial flow fan.

For stability of the structure of each blade 130 of the axial flow fan 100 of the present invention, the blade tips 134 are integrally coupled together by a fan band 140.

Next, the operation and effect of the axial flow fan 100 of the present invention having the above-mentioned structure will be explained herein below.

In the axial flow fan 100 of the present invention, the chord length (CL) around each blade root 132 is longer than that of the intermediate portion of the blade 130, so that the structural stability of the blade 130 is superior. Therefore, compared with conventional axial flow fans having wave shape blades, deformation around each blade tip 134, when the axial flow fan 100 is rotated by a motor coupled to the hub 120, is markedly reduced. Furthermore, in the present invention, the wave shape of the blade 130 is smoother than conventional axial flow fans, and the second inflection point (P2), defined at the second valley of each blade 130, is placed ahead of the first inflection point (P1), defined at the first valley, in a rotational direction. Accordingly, despite a low rotational frequency, satisfactory capacity is achieved, and occurrence of noise is markedly reduced.

Figure 11:
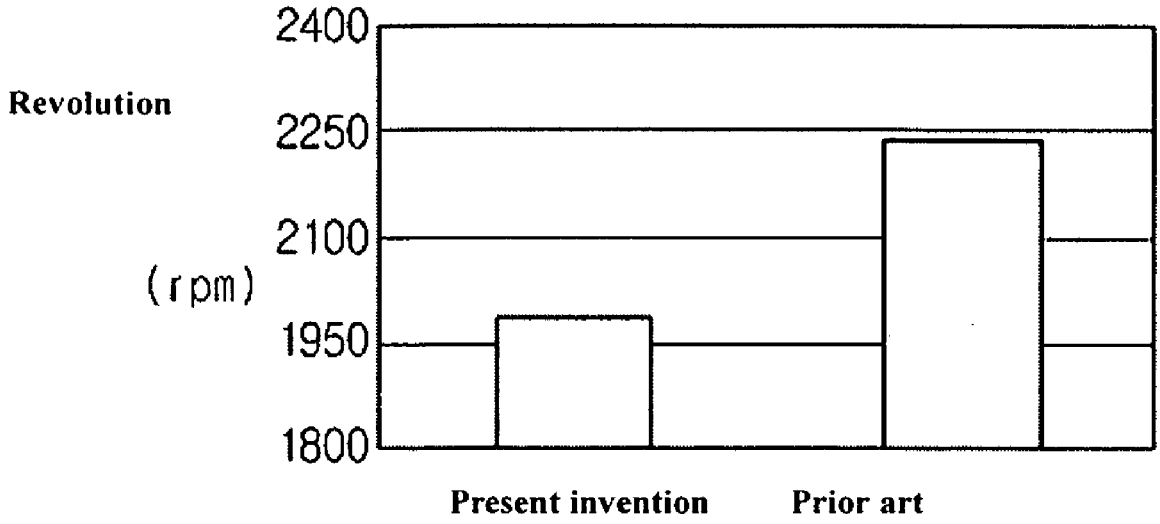
FIG. 11 is a graph comparing the rotational frequencies of the axial flow fan of the present invention and the conventional axial flow fan when they output the same air volume.

FIG. 11 is a graph comparing the rotational frequencies of the axial flow fan 100 of the present invention and a conventional axial flow fan when they output the same air volume. As shown in FIG. 11, when the same air volume of 1,602 CMH (cubic meter per hour) is output, the axial flow fan 100 of the present invention has a rotational frequency of 1,983 rpm, while the conventional axial flow fan has a rotational frequency of 2,237 rpm. As such, it is to be understood that the axial flow fan 100 of the present invention is able to have a rotational frequency 12% less than that of the conventional axial flow fan.

Figure 12:
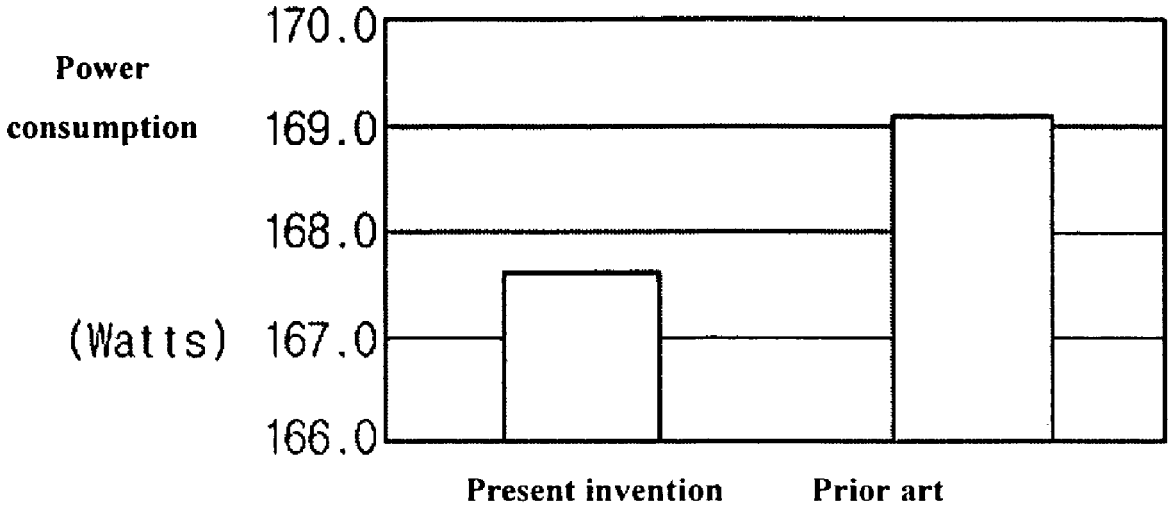
FIG. 12 is a graph comparing the power consumptions of the axial flow fan of the present invention and the conventional axial flow fan when they output the same air volume.

FIG. 12 is a graph comparing the power consumptions of the axial flow fan 100 of the present invention and a conventional axial flow fan when they output the same air volume. As shown in FIG. 12, when the same air volume of 1,602 CMH is output, the power consumption of the axial flow fan 100 of the present invention is 167.6 Watts, while the power consumption of the conventional axial flow fan is 169.1 Watts. As such, it is to be understood that the axial flow fan 100 of the present invention is able to realize power consumption 0.9% less than that of the conventional axial flow fan.

Figure 13:
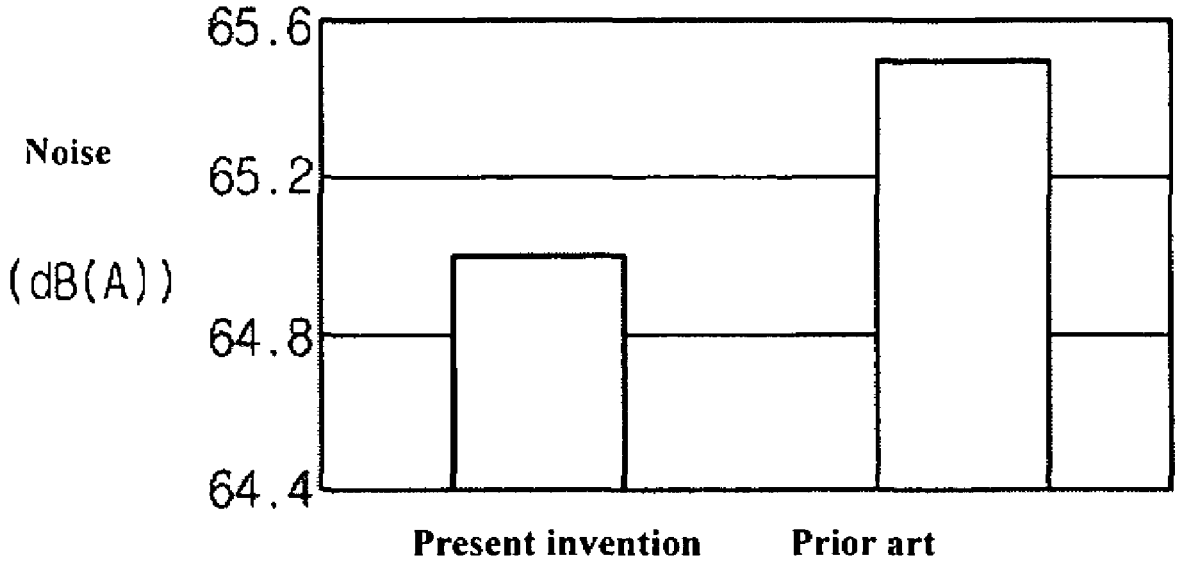
FIG. 13 is a graph comparing noise levels of the axial flow fan of the present invention and the conventional axial flow fan when they output the same air volume.

FIG. 13 is a graph comparing noise levels of the axial flow fan 100 of the present invention and a conventional axial flow fan when they output the same air volume. As shown in FIG. 13, when the same air volume of 1,602 CMH is output, the noise level of the axial flow fan 100 of the present invention is 65.0 dB(A), while the noise level of the conventional axial flow fan is 65.5 dB(A). As such, it is to be understood that the axial flow fan 100 of the present invention is able to reduce noise by 0.5 dB(A) compared with the conventional axial flow fan.

Although the axial flow fan 100 of the preferred embodiment of the present invention, in which the direction of the sweeping angle of each blade 130 is alternately changed by the first and second inflection points (P1) and (P2) defined at two valleys between the blade root 132 and the blade tip 134, has been disclosed for illustrative purposes as an example, the above-mentioned change in the chord length (CL) of each blade and the relationship between the inflection points can be applied to axial flow fans, in which the direction of a sweeping angle of the blade alternately changes at the inflection points defined at three or more valleys of the blade. These axial flow fans also fall within the scope of the present invention.

As described above, the present invention provides an axial flow fan in which a chord length (CL) around each blade root is longer than that of an intermediate portion of the blade, so that the structural stability of the blade is superior. Therefore, deformation around the blade tip, when the axial flow fan is rotated, is markedly reduced. Thus, the durability of the axial flow fan is enhanced.

Furthermore, in the present invention, the wave shape of each blade is smooth, and a second inflection point, defined at a second valley on a mid-chord line of the blade, is placed ahead of a first inflection point, defined at a first valley on the mid-chord line, in a rotational direction. Accordingly, despite a low rotational frequency, satisfactory blast capacity is achieved, and, as well, the occurrence of noise is markedly reduced. In addition, power consumption is reduced. Thus, the axial flow fan of the present invention enhances air blowing efficiency and prevents a user from experiencing discomfort due to noise.

What is claimed is:

1. An axial flow fan, comprising: a hub; and a plurality of blades arranged along a circumferential outer surface of the hub in a radial direction such that the direction of a sweeping angle of each of the plurality of blades alternately changes in a region between a blade root and a blade tip, the blade root being at a junction of the blade and a hub having a center, wherein a chord length extending between a leading edge and a trailing edge of the blade gradually decreases from the blade root to at the junction of the blade and the hub to an intermediate portion of the blade and has a minimum value at a predetermined position on the intermediate portion of the blade, and the chord length gradually increases from the predetermined position of the intermediate portion of the blade having the minimum value to the blade tip, first and second inflection points respectively at first and second points where the sweeping angle of the blade changes between a backward sweeping angle and a forward sweeping angle, the first and second inflection points being spaced apart from each other and the blade root by a predetermined distance on a mid-chord line connecting middle points between the leading edge and the trailing edge, the second inflection point being ahead of the first inflection point, based on a first line passing through both the hub center and an intersection point between the mid-chord line and the blade root, in the direction of blade rotation.

2. The axial flow fan according to claim 1, wherein, when an outer radius of the hub is designated by "Rh", and a distance between the center of the hub and the blade tip is designated by "Rt", and a distance between the center of the hub and an arbitrary position on the mid-chord line is designated by "r", the chord length has the minimum value at a predetermined position satisfying the expression (r−Rh)/(Rt−Rh)=0.20 to about 0.6.

3. The axial flow fan according to claim 2, wherein an angle $\alpha 1$ between the first line, passing through both the center of the hub and the intersection point between the mid-chord line and the blade root, and a second line, passing through both the center of the hub and the intersection point between the mid-chord line and the blade tip, is greater than the angle $\alpha 2$ between the first line and a third line, passing through both the center of the hub and the first inflection point in the mid-chord line, and is greater than the angle $\alpha 3$ between the first line and a fourth line, passing through both the center of the hub and the second inflection point in the mid-chord line.

4. An axial flow fan, comprising: a hub having a center; and a plurality of blades arranged along a circumferential outer surface of the hub in a radial direction such that the direction of a sweeping angle of each of the plurality of blades alternately changes in a region between a blade root and a blade tip, wherein a chord length extending between a leading edge and a trailing edge of the blade gradually decreases from the blade root to an intermediate portion of the blade and has a minimum value at a predetermined position on the intermediate portion of the blade, and the chord length gradually increases from the predetermined position of the intermediate portion of the blade having the minimum value to the blade tip, a second inflection point located at a second valley, said second inflection point located where the sweeping angle of the blade changes from a backward sweeping angle to a forward sweeping angle, and being spaced from the blade root by a predetermined distance and a first inflection point where the sweeping angle of the blades changes from a backward sweeping angle to a forward sweeping angle, the first and second inflection points being spaced from each other, a first line passing through the center of the hub and the intersection point between a mid-chord line and the blade root in the blade rotation direction, said second inflection point being located in front of the first line passing through the center of the hub and the intersection point between the mid-chord line and the blade root in the blade rotation direction, wherein, when an outer radius of the hub is designated by "Rh", and the distance between the hub center and the blade tip is designated by "Rt", and the distance between the center of the hub and an arbitrary position on the mid-chord line is designated by "r", the chord length has the minimum value at a predetermined position satisfying the expression (r−Rh)/(Rt−Rh)=in the range of 0.2 to about 0.6, wherein an angle $\alpha 1$ between the first line, passing through both the hub center and the intersection point between the mid-chord line and the blade root, and a second line, passing through both the center of the hub and the intersection point between the mid-chord line and the blade tip, is greater than the angle $\alpha 2$ between the first line and a third line, passing through both the center of the hub and the first inflection point in the mid-chord line, and is greater than the angle $\alpha 3$ between the first line and a fourth line, passing through both the center of the hub and the second inflection point in the mid-chord line, wherein the angle $\alpha 2$ between the first line, passing through both the center of the hub and the intersection point between the mid-chord line and the blade root, and the third line, passing through both the center of the hub and the first inflection point, is less than ½ of the angle α1 between the first line and the second line, passing through both the center of the hub and the intersection point between the mid-chord line and the blade tip.

5. The axial flow fan according to claim 1, further comprising: a fan band that integrally couples the blade tips of the plurality of blades together.

6. An axial flow fan, comprising:

a hub; and a plurality of blades arranged along a circumferential outer surface of the hub in a radial direction such that the direction of a sweeping angle of each of the plurality of blades alternately changes in a region between a blade root and a blade tip, wherein a chord length, having a length from a leading edge to a trailing edge of the blade, which gradually decreases from the blade root to an intermediate portion of the blade and has a minimum value at a predetermined position on the intermediate portion of the blade, while the chord length gradually increases from the predetermined position of the intermediate portion of the blade having the minimum value to the blade tip, and a second inflection point, defined at a second valley spaced apart from the blade root by a predetermined distance on a mid-chord line connecting middle points between the leading edge and the trailing edge, is located ahead of a first inflection point, defined at a first valley between the blade root and the second valley on the mid-chord line, based on a first line passing through both a center of the hub and an intersection point between the mid-chord line and the blade root, in a direction of rotation; wherein: (a) the outer radius of the hub is designated by "Rh", (b) the distance between the center of the hub and the blade tip is designated by "Rt", (c) the distance between the center of the hub and an arbitrary position on the mid-chord line is designated by "r", (d) the chord length has a minimum value at a predetermined position in accordance within the range of (r−Rh)/(Rt−Rh)=0.20 to about 0.6, (e) the angle α1 between (i) the first line, passing through both the center of the hub and the intersection point between the mid-chord line and the blade root, and (ii) a second line, passing through both the center of the hub and an intersection of the mid-chord line and the blade tip, is greater than an angle α2 between the first line and a third line, passing through both the center of the hub and the first inflection point in the mid-chord line, and the angle α1 is greater than an angle α3 between the first line and a fourth line, passing through both the center of the hub and the second inflection point in the mid-chord line, and (I) the angle α2 between the first line, passing through both the center of the hub and the intersection point between the mid-chord line and the blade root, and the third line, passing through both the center of the hub and the first inflection point, is less than ½ of the angle α1 between the first line and the second line, passing through both the center of the hub and the intersection point between the mid-chord line and the blade tip.

* * * * *